US006290348B1

(12) United States Patent
Becker et al.

(10) Patent No.: US 6,290,348 B1
(45) Date of Patent: Sep. 18, 2001

(54) TECHNIQUES FOR PROVIDING INK-JET CARTRIDGES WITH A UNIVERSAL BODY STRUCTURE

(75) Inventors: Richard A. Becker, Poway, CA (US); John B. R. Dunn, Corvallis, OR (US); David A. Bradley, Jr.; Michael W. Keyes, both of Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/478,148

(22) Filed: Jan. 5, 2000

(51) Int. Cl.[7] ..... B41J 2/175
(52) U.S. Cl. ..... 347/87; 347/86
(58) Field of Search ..... 347/85, 86, 87, 347/66, 117, 123

(56) References Cited

U.S. PATENT DOCUMENTS

| | | | | |
|---|---|---|---|---|
| 4,771,295 | * | 9/1988 | Baker et al. | 347/87 |
| 4,885,595 | | 12/1989 | Kaplinsky et al. | 347/85 |
| 5,467,118 | | 11/1995 | Gragg et al. | 347/87 |

FOREIGN PATENT DOCUMENTS

| | | |
|---|---|---|
| 0713778 | 5/1996 | (EP) . |
| 0845363 | 6/1998 | (EP) . |

OTHER PUBLICATIONS

"Design and Development of a Color Thermal Inkjet Print Cartridge," Baker et al., Hewlett–Packard Journal, Aug. 1988, pp. 6–15.

"Development of a Color Graphics Printer," Smith et al., Hewlett–Packard Journal, Aug. 1988, pp. 16–21.

"Mechanical Design of a Color Graphics Printer," Ta et al., Hewlett–Packard Journal, Aug. 1988, pp. 21–27.

"The Second–Generation Thermal Inkjet Structure," Askeland et al., Hewlett–Packard Journal, Aug. 1988, pp. 28–31.

"High Volume Microassembly of Color Thermal Inkjet Printheads and Cartridges," Boeller et al., Hewlett–Packard Journal, Aug. 1988, pp. 32–40.

"Ink Retention in a Color Thermal Inkjet Pen," Ertuk et al., Hewlett–Packard Journal, Aug. 1988, pp. 41–44.

"Ink Media Development for the HP PaintJet Printer," Palmer et al., Hewlett–Packard Journal, Aug. 1988, pp. 45–50.

"Color Thermal Inkjet Printer Electronics," Hollis et al., Hewlett Packard Journal, Aug. 1988, pp. 51–56.

* cited by examiner

*Primary Examiner*—N. Le
*Assistant Examiner*—Anh T. N. Vo

(57) ABSTRACT

A universal inkjet cartridge body with multiple ink reservoirs that can be used for single color or multiple color applications. The ink flow routing is accomplished by merely changing the printhead-to-body sealing structure, which can be an adhesive pattern. This allows for all the reservoirs' inks to be mixed at the head for one cartridge configuration, or the respective inks can be directed to different parts of the printhead for a multiple color application. The same cartridge body structure can be used for two or more cartridge configurations. A nose piece structure defines multiple ink channels leading from the respective ink reservoirs to a printhead mounting region. The sealing structure is applied to mount the printhead to the nose piece and to complete the ink path routing from the reservoirs to the printhead nozzle array(s).

17 Claims, 3 Drawing Sheets

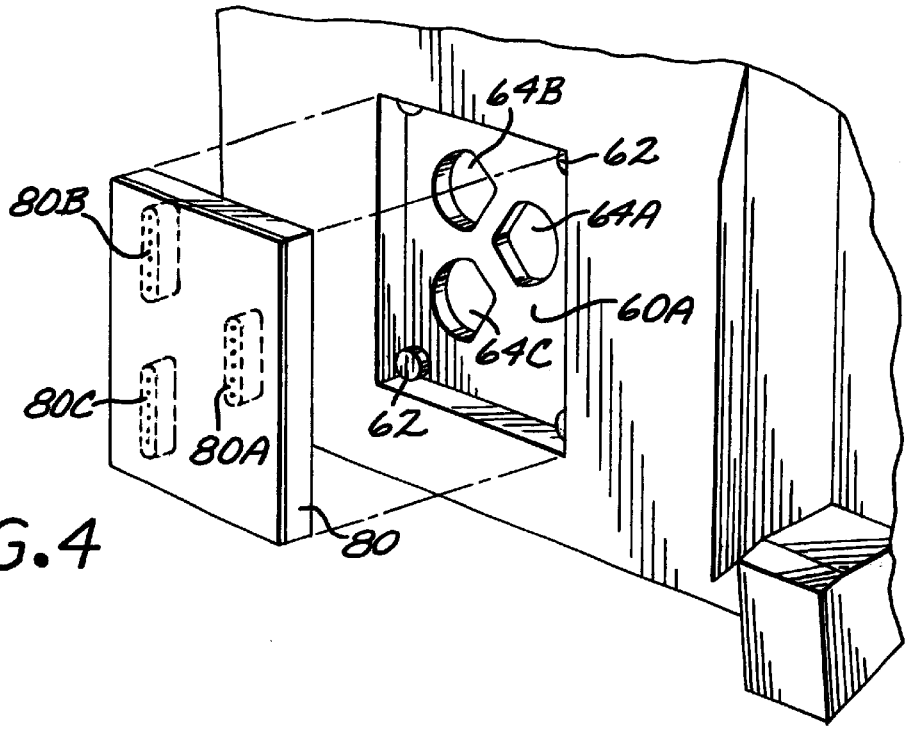
FIG.4
FIG.5
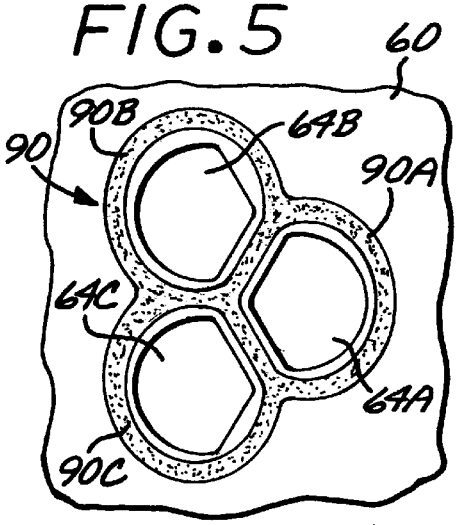
FIG.6
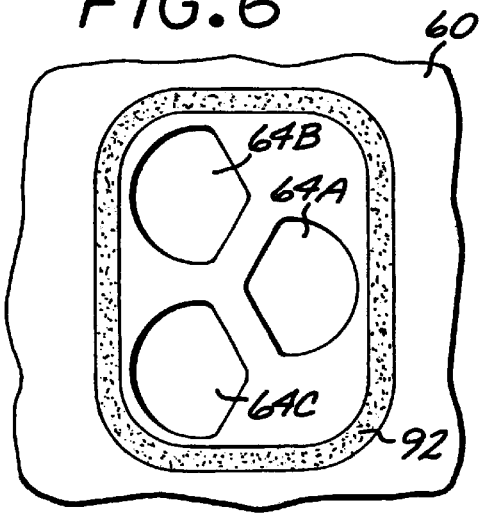
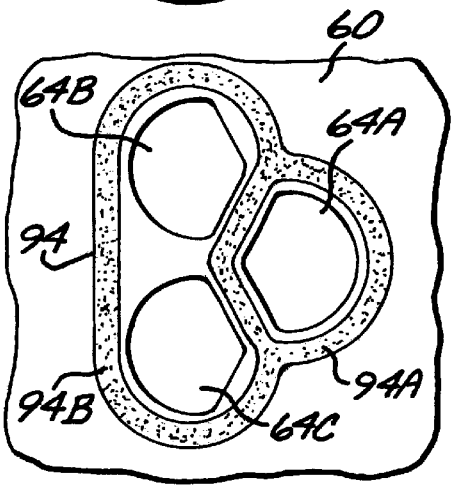
FIG.7
FIG.8
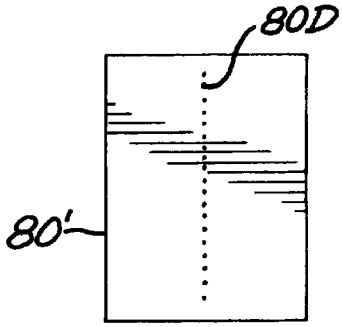

TECHNIQUES FOR PROVIDING INK-JET CARTRIDGES WITH A UNIVERSAL BODY STRUCTURE

CROSS-REFERENCE TO RELATED APPLICATIONS

This application is related to the following copending utility patent applications, each filed concurrently on Jan. 5, 2000: Ser. No. 09/477,645, by Ram Santhanam et al., entitled "Vent For An Ink-Jet Print Cartridge"; Ser. No. 09/477,646, by Ram Santhanam et al., entitled "Ink-Jet Print Cartridge Having A Low Profile"; Ser. No. 09/477,644, by Junji Yamamoto et al., entitled "Horizontally Loadable Carriage For An Ink-Jet Printer"; Ser. No. 09/477,649, by Junji Yamamoto et al., entitled "Method And Apparatus For Horizontally Loading And Unloading An Ink-Jet Print Cartridge From A Carriage"; Ser. No. 09/477,843, by Ram Santhanam et al., entitled "Techniques For Adapting A Small Form Factor Ink-Jet Cartridge For Use In A Carriage Sized For A Large Form Factor Cartridge"; Ser. No. 09/478,190, by James M. Osmus, entitled "Printer With A Two Roller, Two Motor Paper Delivery System"; Ser. No. 09/477,648, by Keng Leong Ng, entitled "Low Height Inkjet Service Station "; Ser. No. 09/477,860 by Matt Shepherd et al., entitled "New Method Of Propelling An Inkjet Printer Carriage"; Ser. No. 29/116,564, by Ram Santhanam et al., entitled "Ink Jet Print Cartridge "; and Ser. No. 09/477,940, by Ram Santhanam et al., entitled "Multiple Bit Matrix Configuration For Key-Latched Printheads "; the entire contents of which applications are incorporated herein by reference.

TECHNICAL FIELD OF THE INVENTION

The present invention relates to ink jet print cartridges, and more particularly to techniques for employing a common cartridge body for multiple cartridge applications.

BACKGROUND OF THE INVENTION

Ink-jet printers are in widespread use today for printing functions in personal computer, facsimile and other applications. Such printers typically include replaceable or semi-permanent print cartridges which hold a supply of ink and carry the ink-jet printhead. The cartridge typically is secured into a printer carriage which supports one or a plurality of cartridges above the print medium, and traverses the medium in a direction transverse to the direction of medium travel through the printer. Electrical connections are made to the printhead by flexible wiring circuits attached to the outside of the cartridge. Each printhead includes a number of tiny nozzles defined in a substrate and nozzle plate structure which are selectively fired by electrical signals applied to interconnect pads to eject droplets of ink in a controlled fashion onto the print medium.

In order to achieve accurate printing quality, each removable cartridge includes datum surfaces which engage against corresponding carriage surfaces to precisely locate the cartridge when inserted into the carriage. In this manner, when a cartridge ink supply is exhausted, the cartridge may be replaced with a fresh cartridge, and the printhead of the new cartridge will be precisely located relative to the carriage.

Different cartridge bodies have typically been employed for multi-color and monochrome inkjet cartridges, incurring expenses in the design and tooling for the different bodies. Multicolor cartridges are a common, physically compact inkjet solution, but unless the user prints equal quantities of all colors, ink is discarded when the disposable cartridge empties any one color.

Another approach to best match the customer consumption of individual colors is to provide individual completely independent single color cartridges or individual inkjet reservoirs.

These solutions are generally physically large and require the development, tooling, stocking, etc. of multiple components. This leads to different production processes, even entirely different assembly lines, to manufacture these different cartridges.

It would therefore represent an advance in the art to provide a technique for using a common cartridge body in multiple applications.

SUMMARY OF THE INVENTION

A universal inkjet cartridge body with multiple ink reservoirs is described that can be used for single color or multiple color applications. The ink flow routing is accomplished by merely changing the printhead-to-body "gasketing" (adhesive pattern). This allows for all or some of the reservoirs' ink to be mixed at the head, or the respective inks can be directed to different parts of the printhead.

In accordance with another aspect of the invention, a method is described for fabricating an inkjet printer cartridge, comprising:

providing a cartridge body having a plurality of compartments, each for holding a separate supply of ink, each compartment having an outlet port, the body further including isolated ink flow paths running leading from an outlet port to a printhead mounting region;

selecting one of a plurality of cartridge configurations;

based on the selected cartridge configuration, completing an ink flow path configuration between the respective ink flow paths and the printhead mounting region which determines whether each ink flow path remains isolated from other ink flow paths or is allowed to join with one or more of the other ink flow paths; and mounting an ink-jet printhead to the mounting region.

BRIEF DESCRIPTION OF THE DRAWING

These and other features and advantages of the present invention will become more apparent from the following detailed description of an exemplary embodiment thereof, as illustrated in the accompanying drawings, in which:

FIG. 4 is an exploded diagrammatic illustration of the printhead die positioned away from the nose piece recess.

FIGS. 5, 6 and 7 show three different exemplary adhesive patterns for attaching the printhead to the nose piece.

FIG. 8 is a diagrammatic illustration of a monochrome printhead.

DETAILED DESCRIPTION OF THE PREFERRED EMBODIMENTS

Figure 1:
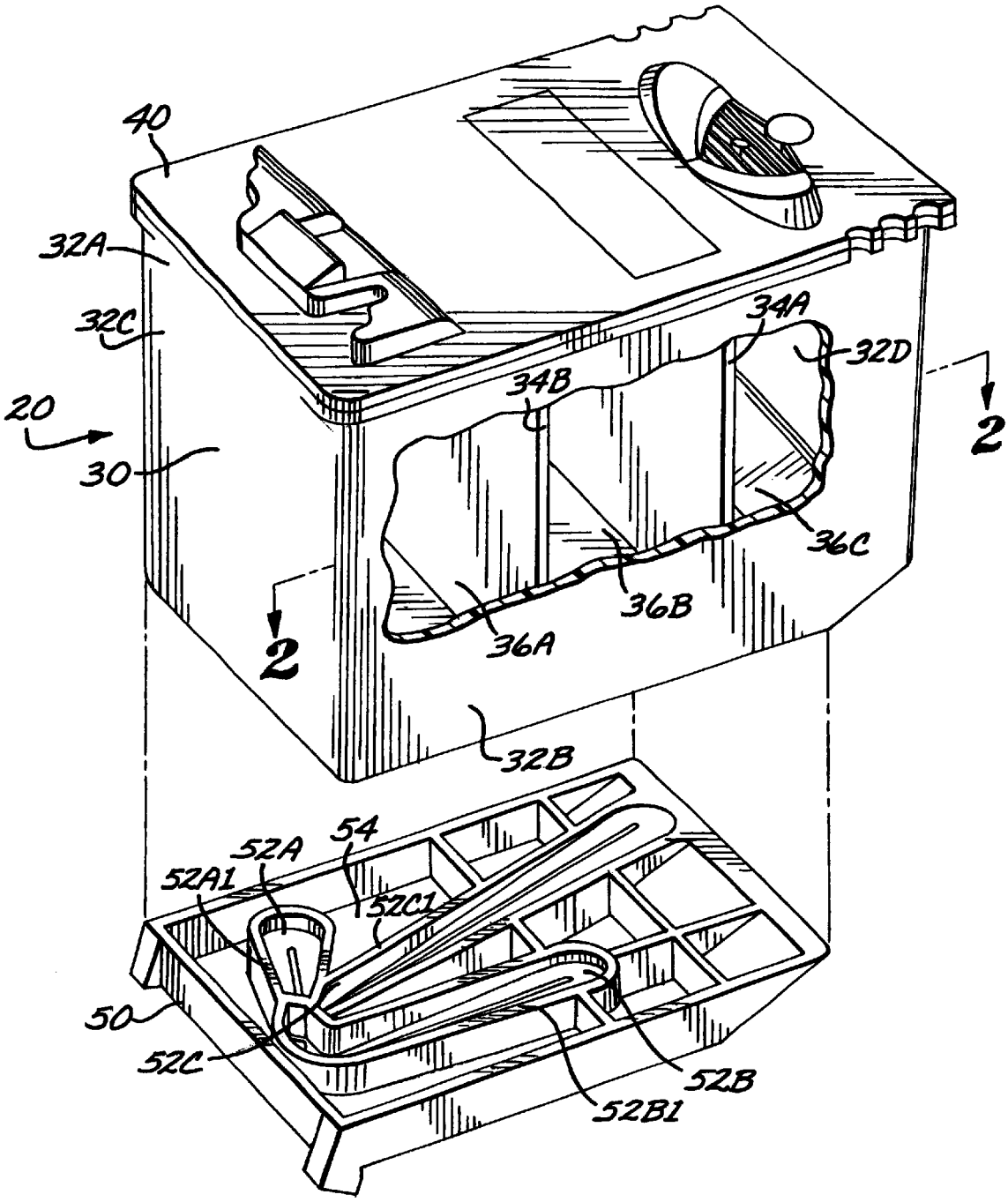
FIG. 1 is an isometric, partially exploded and broken away view of a universal ink-jet printer cartridge in accordance with the invention.
Figure 2:
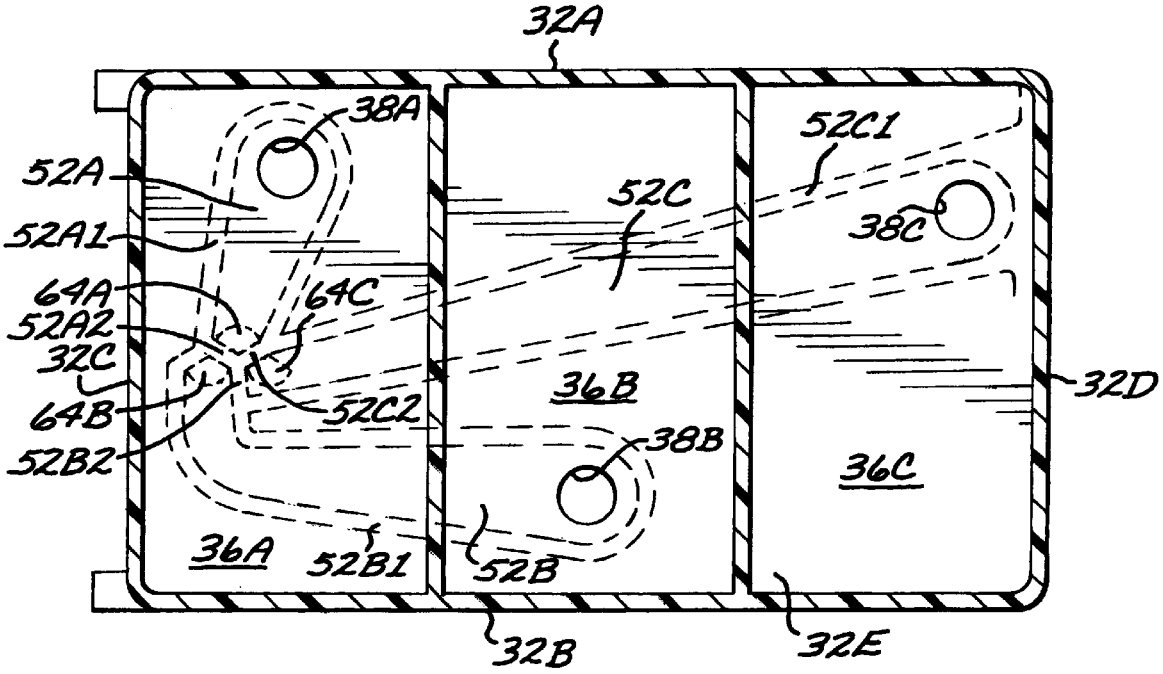
FIG. 2 is a cross-sectional view taken through line 2—2 of FIG. 1.
Figure 3:
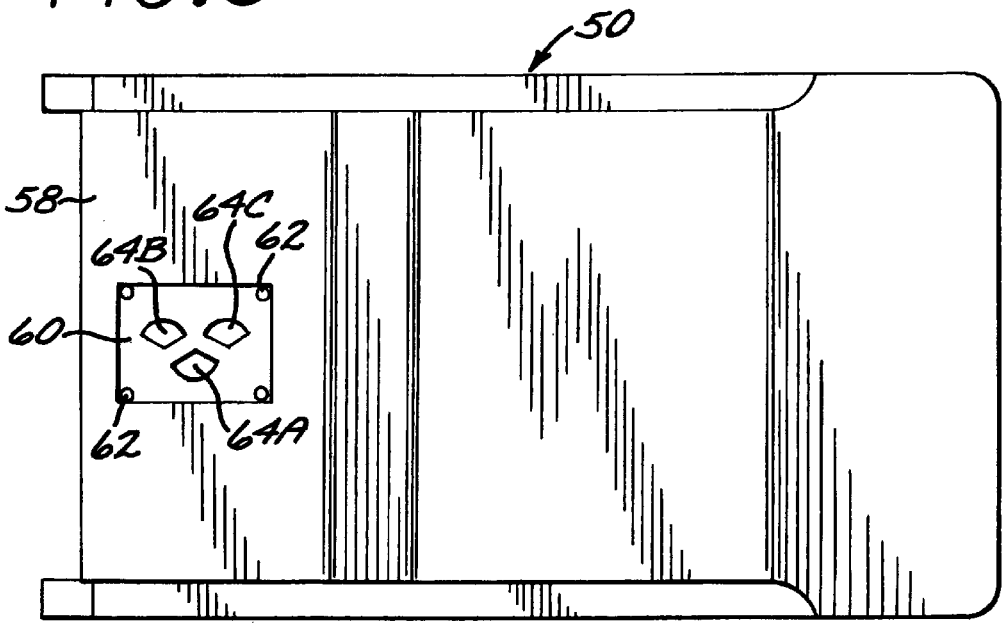
FIG. 3 is a bottom view of the cartridge body of FIG. 1, illustrating features of the nose piece.

An ink-jet cartridge 20 embodying this invention is illustrated in FIGS. 1–3. The cartridge has an external structure comprising multi-compartment main body 30, a top cap 40, and a nose piece 50. In this exemplary embodiment, each of the members 30, 40 and 50 is a unitary molded part fabricated of a plastic material, such as injection molded polysulfone, PET, ABS and other polymers, both filled and unfilled with glass or other materials. The top cap 40 is attached to the main body 30 during an assembly process, e.g. by ultrasonic welding, adhesive or other suitable bonding technique. The top cap 30 is described more fully in the copending application entitled "Vent For An ink-Jet Print Cartridge, referenced above. Similarly, the nose piece 50 is attached to the bottom of the main body during the assembly process, using a similar bonding technique.

The main body 30 is of rectilinear cross-section, with opposed long side walls 32A, 32B, end walls 32C, 32D and a bottom wall 32E. Interior partition walls 34A, 34B extend across the interior of the body between side walls 32A and 32B, and divide the interior volume of the body member 30 into three compartments 36A, 36B and 36C in this embodiment. Of course the particular number of compartments could be more or less than three. The bottom wall 32E has formed therein respective openings 38A, 38B and 38C to provide an ink flow path from the respective chambers 36A, 36B and 36C into the nosepiece 50.

During the assembly process for this exemplary embodiment, compressed foam elements are respectively inserted into the respective chambers 36A, 36B and 36C, to create via capillary action a negative ink pressure to prevent ink drooling from the printhead. Use of foam for this purpose is well known in the art.

The nose piece 50 includes respective interior ink channels 52A, 52B and 52C which, when the part 50 is assembled to the body 30, lead from the respective openings 38A, 38B and 38C to respective outlet ports or openings 64A, 64B, 64C in the nose piece channel floors. The channels are constructed such that, when the cartridge is mounted in a printer carriage for printing, the floors of the respective channels drop slightly in elevation, so that any air bubbles in the liquid ink in each channel will flow away from the printhead. Each channel is defined by a channel wall structure which protrudes upwardly from the channel floor to a height sufficient to bond to the bottom surface of the floor 32E of the main body. Thus, to prevent ink leakage from one compartment of the main body outside the channels, an ink seal is formed during the bonding of the nose piece 50 and the body 30, such that the top of each channel wall is bonded to the bottom surface of the body. This can be accomplished by use of ultrasonic welding, adhesives or other suitable bonding techniques and processes. The ink feed channels are sealed to the body during the bonding process.

FIG. 2 shows the relative orientation of the body compartments 36A, 36B, 36C, the openings 38A, 38B and 38C formed in the body floor and the channels 52A, 52B and 52C.

FIGS. 3 and 4 illustrate the bottom of the nose piece 50, and shows the flat surface 58 with a shallow pocket or recess 60 formed therein. The pocket 60 receives the printhead substrate 80 (FIG. 4) during assembly. In an exemplary embodiment, the pocket has a depth of 0.6 mm, but this of course will vary depending on the particular printhead substrate characteristics. The pocket has formed in each corner respective standoff structures 62 which define datum surfaces for precisely locating the substrate relative to the nose piece 50. The substrate 80 is mounted so that the facing surface of the substrate contacts the four datums 62.

FIGS. 3 and 4 also show the respective openings 64A, 64B and 64C formed in the nose piece 50, and which provide respective fluid communication paths through the surface 58, and between the channels 52A, 52B, 52C and the pocket 60. Thus, the surface 58 and the channels provide a barrier structure which maintains separation between the respective inks from the compartments of the body in the interior of the nose piece. However, within the pocket 60 on the exterior of the nose piece, the nose piece itself does not prevent mixing of the inks.

The openings 64A, 64B and 64C are pie or sector shaped openings with two flat sides joined by an arc portion. The openings are oriented so that a flat side of each opening is adjacent to a flat side of another opening. This configuration provides maximum flow area through the openings while still allowing reasonable area of the nose piece material between the openings to allow for adhesive application.

In accordance with an aspect of the invention, a sealing structure is provided between the floor 60A (FIG. 4) of the pocket and the printhead substrate which adheres between the substrate and the pocket floor, and which defines a seal pattern or a gasket pattern which is dependent on the type of print cartridge to be manufactured. Each printhead substrate 80 has formed therein a nozzle array structure, comprising one or more nozzle arrays. For example, substrate 80 in FIG. 4 is shown with three nozzle arrays 80A, 80B and 80C, each comprising one or more columns of nozzles. By creating partitions around respective ones or groups of the openings 64A–64C, one can select whether ink from each compartment 32A–32C will be directed to a single nozzle array, or be mixed with ink from another compartment.

The sealing structure feature is illustrated in FIGS. 5–7, which show different patterns of a gasket or adhesive structure. FIG. 5 illustrates a sealant pattern in the form of a "pretzel" shape, wherein each opening 64A–64C has a respective partition structure portion 90A–90C formed around it. This partition structure isolates each opening from the other openings, preventing color mixing in the pocket area. This partition structure can be used to direct ink of different colors to different ones of the nozzle arrays 80A–80C.

FIG. 6 shows a partition structure 92 which includes a single partition structure portions surrounding all three openings 64A–64C. This partition structure permits ink from all three compartments to mix in the pocket region, and so is useful for a single color print cartridge structure. In this example, the substrate may include only a single nozzle array, or it may be identical to the nozzle array used with the partition structure of FIG. 5, with all three nozzle arrays used for the same color.

FIG. 7 illustrates a partition structure 94 which defines two sub-partition structures 94A and 94B. The sub-partition structure surrounds just the opening 64A, and so provides isolation for the ink in compartment 32A from the inks in the other compartments. The sub-partition structure 94B is large enough to encompass the two openings 64B and 64C, and so permits ink from compartments 32B and 34C to mix at the pocket region. This partition structure 94 is useful for a two color print cartridge, wherein ink of the same color, e.g. black, is held in compartments 32B, 32C, and ink of a different color is held in compartment 32A. The substrate 80 for this example includes at least two nozzle arrays, one positioned over the sub-partition 94B, the other positioned over the sub-partition 94A.

Typical adhesives suitable for fabricating the partition structures 90–94 include heat curable epoxies, applied from one needle or an array of needles in an automated tool. The needle or array of needles is mounted on a dispensing head, which is positioned with high precision by a vision assisted automated tool. When a single needle is used, the needle is moved through a path of movement to dispense a bead of adhesive or discrete drops of liquid or semi-liquid adhesive, to define the partition structure. When an array of needles is used, the needles are positioned in the configuration of the partition structure, and a single motion of the tool head can be used to dispense the adhesive material. After the adhesive has been dispensed, the printhead substrate is positioned in the pocket, and the bottom surface of the substrate is brought into contact with the adhesive. The adhesive is then cured by application of heat in this exemplary embodiment.

A universal cartridge body in accordance with an aspect of this invention can be used to serve several applications with a single tooling set, a single manufacturing line and a single set of components. For example, in accordance with an aspect of the invention, a tri-reservoir body as illustrated in FIGS. 1 and 2 can be used to make several different cartridges with many of the same components and processes. One cartridge variation is a tri-color, cyan (C), magenta (M) and yellow (Y), using a sealant structure illustrated in FIG. 5. The sealant structure shown in FIG. 5 has been in long use for dedicated tri-color cartridges with a tri-color printhead. Another cartridge variation is a full black (K) pen, with all three reservoir compartments used for black ink, using a sealant structure shown in FIG. 6. A third variation is a three-compartment cartridge with black ink in two of the reservoirs and with a spot color, say blue, in the third compartment, using a sealant structure shown in FIG. 7.

The invention is not limited to use with a multiple nozzle array printhead as shown in FIG. 4. The sealant structure of FIG. 6 is suitable for use with a monochrome printhead such as printhead 80' illustrated in FIG. 8, with a single nozzle array 80D. In this case, the sealant structure 92 will deliver ink from all compartments of the body to the nozzle array.

It will be appreciated that the printer will need to know which version of the cartridge is mounted in the printer, i.e. for the example illustrated, whether the cartridge is a monochrome version, a tri-color version, or a two-color version. This is so the printer driver will apply appropriate drive signals to the cartridge. This can be implemented by a manual command to the printer by the user, by printer software, or by an automatic reading of the cartridge type by the printer when the cartridge is installed, e.g.,by reading cartridge version data stored on the cartridge. Encoding information on the cartridge for reading by the printer is known in the art.

In accordance with another aspect of the invention, a universal body also delivers flexibility to balance colors to meet market needs without redesigning the cartridges and the corresponding manufacturing equipment and processes, including material handling process steps to accommodate different components. For example a black and red cartridge with a 4-reservoir body could be "adjusted" post-introduction to deliver the best balance of black and red. Having this "adjustability" can speed the design cycle by decoupling the design from color-balance usage research and estimations. A post-introduction redesign of the reservoirs using conventional methods would ripple through most of the ink delivery system and be very expensive (e.g., for an exemplary embodiment, requiring a new lid, lid weld, new foam, new foam stuff process, new nose piece and nose weld process).

To illustrate this aspect of the invention, consider the following example of balancing of a 4 compartment, black and red cartridge for receipt printing. Say that the initial design center assumption of usage is 80% black, 20% red. For this assumption, the design would have three black ink compartments, and one red ink reservoir. Actual ink usage is later determined to be closer to 50% black, 50% red, with customers using the color capability more than expected. This results in some wasting of black ink, since the red ink will then be depleted before the black ink. The solution is to now fill two ink chambers with black ink, two with red ink, and modify the sealing structure accordingly. This balancing flexibility eliminates the need to design and manufacture two different cartridge bodies.

In an alternate embodiment, separate nose pieces can be employed for redistributing the ink flow upstream from the pocket area. In this case, the nose piece is modified from the fully isolated case, shown in FIG. 2, by removing a small area of material which separates the ink channels. For example, the small wall portion 52A2 (FIG. 2) could be eliminated to allow ink flow and mixing between channel 52A and channel 52B. Wall portion 52B2 could be eliminated to allow ink flow and mixing between channel 52B and channel 52C. Wall portion 52C2 could be eliminated to allow ink flow and mixing between channel 52A and channel 52C. For this alternate embodiment, sealing structure pattern 90 (FIG. 5) could be employed for all variations of the nose piece.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for fabricating an inkjet printer cartridge, comprising:

providing a cartridge body having a plurality of compartments, each for holding a separate supply of ink, each compartment having an outlet port, the cartridge body further including isolated ink flow channels running from one of said outlet ports to a printhead mounting region;

selecting one of a plurality of cartridge configurations using said cartridge body, said plurality of cartridge configurations including a first configuration wherein respective inks contained within the plurality of remain isolated from each other as the respective inks are passed from the respective outlet ports to the printhead mounting region, and a second configuration wherein the respective inks from two or more of the plurality of compartments are mixed as the respective inks are passed from the corresponding respective outlet ports to the printhead mounting region;

based on the selected cartridge configuration, completing an ink flow path configuration between the ink flow channels and the printhead mounting region which determines, for the first configuration, that each ink flow channel remains isolated from other ink flow channels in the printhead mounting region, and for the second configuration, that an ink flow channel is joined with one or more of the other ink flow channels in the printhead mounting region; and mounting an ink-jet printhead to the printhead mounting region.

2. The method of claim 1 wherein the printhead includes a plurality of nozzle arrays, and wherein, for the first configuration:

said step of completing an ink flow path configuration includes providing a structure in said printhead mounting region which provides isolated flow paths running from each of said isolated ink flow channels to a corresponding nozzle array.

3. The method of claim 1 wherein the cartridge body includes a compartment body structure and a separate nose piece structure defining the respective ink flow paths, wherein each configuration is defined by a different nose piece structure, and wherein the step of completing the ink flow path configuration includes attaching a selected one of a set of different nose piece structures to the compartment body structure.

4. A method for fabricating an inkjet printer cartridge, comprising:

providing a cartridge body structure having a plurality of compartments, each for holding a supply of ink, each compartment having an outlet port leading to a common pocket region, each of the outlet ports terminating at a pocket area spatially separated from the other outlet ports;

applying an adhesive in liquid form in a pattern in the common pocket region, the pattern selected to provide a partition structure to link at least some of the pocket areas;

mounting a printhead structure having a nozzle array pattern over the pocket region such that a surface of the printhead structure is brought into contact with the adhesive pattern;

allowing the adhesive to cure to an essentially solid state, thereby bonding the printhead to the body, wherein the partition structure allows mixing ink from at least two of said outlet ports.

5. The method of claim 4, wherein the plurality of compartments includes at least three compartments, and wherein the ink supply in two of said compartments is of the same color of ink, and the ink supply in a third compartment is of a different color of ink, and wherein the partition structure allows ink mixing between the compartments holding supplies of inks of the same color.

6. The method of claim 4, wherein the cartridge body structure includes a cartridge body defining the plurality of compartments and a nose piece structure which defines said pocket region and a plurality of ink channels connecting between said pocket region and respective outlet ports of the compartments, wherein one of the plurality of ink channels are isolated from others of said plurality of ink channels.

7. The method of claim 4, further comprising the step of selecting the pattern in which the adhesive is applied to determine a particular ink mixing configuration.

8. The method of claim 4 wherein the printhead mounting adhesive is a heat-curable adhesive, and wherein the step of allowing the printhead mounting adhesive to cure to a solid state includes applying heat to the printhead structure.

9. An inkjet printer cartridge, comprising:

a cartridge body structure having a plurality of compartments, each for holding a supply of ink, each compartment having an outlet port leading to a common pocket region, each of the outlet ports terminating at a pocket area spatially separated from the other outlet ports;

a printhead structure having a nozzle array pattern, said printhead structure mounted over the pocket region;

a gasket structure mounted between the printhead structure and body surfaces defining the plenum, the gasket structure providing an ink seal between the cartridge body and the printhead and a partition structure to link at least two of the pocket areas to allow ink mixing between inks held in at least two corresponding ink compartments.

10. The cartridge of claim 9, wherein the plurality of compartments includes at least three compartments, and wherein the ink supply in two of said compartments is of the same color of ink, and the ink supply in a third compartment is of a different color of ink, and wherein the gasket structure allows mixing of ink from the compartments holding ink supplies of ink of the same color.

11. The cartridge of claim 9, wherein the cartridge body structure includes a cartridge body defining the plurality of compartments and a nose piece structure which defines said pocket region and a plurality of ink channels connecting between said pocket region and respective outlet ports of the compartments, wherein the respective ink channels are isolated from the other ink channels.

12. The cartridge of claim 9 wherein the gasket structure is defined by an adhesive material.

13. A universal inkjet cartridge body with multiple ink reservoirs usable for single color or multiple color applications, the body including a printhead mounting region for mounting a printhead by use of an adhesive material applied in an adhesive pattern, and wherein ink flow routing between the ink reservoirs and the printhead is completed by the adhesive pattern, wherein for a single color application the adhesive pattern permits all of the inks in said multiple ink reservoirs to be mixed at a head mounting region upstream of the printhead, or for a multiple color application the adhesive pattern isolates and directs the inks in said ink reservoirs to different nozzle array parts of the printhead, thereby allowing the universal cartridge body to be used for single color or multiple color cartridge applications.

14. A method for fabricating an inkjet printer cartridge, comprising:

providing a cartridge body having a plurality of compartments, each for holding a separate supply of ink, each compartment having an outlet port, the cartridge body further including isolated ink flow channels running from one of said outlet ports to a printhead mounting region;

selecting one of a plurality of cartridge configurations using said cartridge body, said plurality of cartridge configurations includes an ink mixing configuration in which ink from at least two of said compartments are allowed to mix upstream from the printhead;

based on the selected cartridge configuration, completing an ink flow path configuration between the ink flow channels and the printhead mounting region which determines whether each ink flow channel remains isolated from other ink flow channels in the printhead mounting region or is allowed to join with one or more of the other ink flow channels in the printhead mounting region, including for said ink mixing configuration providing a set of ink flow paths which allow said ink from said at least two of said compartments to mix between the flow paths of the set at a region upstream of the printhead; and mounting an ink-jet printhead to the printhead mounting region.

15. The method of claim 14 wherein said set of ink flow paths includes a first isolated ink flow path leading from one of said ink flow channels to a first isolated nozzle array region on the printhead, and wherein the set of ink flow paths allow ink which has mixed from said at least two of said compartments to flow to a second nozzle array region on the printhead, and wherein:

said step of completing an ink flow path configuration further includes providing the first isolated ink flow path leading from said one of said ink flow channels to the first isolated nozzle array region.

16. A method for fabricating an inkjet printer cartridge, comprising:

providing a cartridge body having a plurality of compartments, each for holding a separate supply of ink, each compartment having an outlet port, the cartridge body further including isolated ink flow channels running from one of said outlet ports to a printhead mounting region;

selecting one of a plurality of cartridge configurations using said cartridge body, said plurality of cartridge configurations including a first configuration wherein respective inks contained within the plurality of remain isolated from each other as the respective inks are passed from the respective outlet ports to the printhead mounting region, and a second configuration wherein the respective inks from two or more of the plurality of compartments are mixed as the respective inks are passed from the corresponding respective outlet ports to the printhead mounting region;

based on the selected cartridge configuration, completing an ink flow path configuration between the ink flow channels and the printhead mounting region which determines whether each ink flow channel remains isolated from other ink flow channels in the printhead mounting region, and for the second configuration, that an ink flow channel is joined with one or more of the other ink flow channels in the printhead mounting region, said step of completing an ink flow path configuration including forming a partition structure in the printhead mounting region using a printhead mounting adhesive, a configuration of the partition structure determining whether ink from any of the compartments is allowed to mix with ink from any other of the compartments; and mounting an ink-jet printhead to the printhead mounting region, including bringing the printhead into contact with the partition structure.

17. The method of claim 16 wherein the printhead mounting adhesive is a heat cured adhesive applied in a liquid or semi-liquid state, and which is curable to a solid state by application of heat during said mounting step.

* * * * *